United States Patent [19]

Warren

[11] Patent Number: 4,671,454

[45] Date of Patent: Jun. 9, 1987

[54] TOP OPEN RETURN ENVELOPE MAILER WITH TEAR TAB PERFORATIONS

[75] Inventor: James R. Warren, Twin Falls, Id.

[73] Assignee: Moore Business Forms, Inc., Grand Island, N.Y.

[21] Appl. No.: 870,436

[22] Filed: Jun. 4, 1986

Related U.S. Application Data

[63] Continuation of Ser. No. 670,389, Nov. 13, 1984, abandoned.

[51] Int. Cl.[4] ..... B65D 27/10

[52] U.S. Cl. ..... 229/69; 206/610; 206/632; 282/11.5 R

[58] Field of Search ..... 229/68 R, 69; 206/610, 206/632; 282/11.5 A, 11.5 R, 25

[56] References Cited

U.S. PATENT DOCUMENTS

| | | | |
|---|---|---|---|
| 3,841,549 | 10/1974 | Wakeman | 229/69 |
| 4,002,290 | 1/1977 | Van Malderghem | 229/69 |
| 4,010,889 | 3/1977 | Allen et al. | 229/69 |
| 4,051,995 | 10/1977 | Wieman | 229/69 |
| 4,055,294 | 10/1977 | Traise | 229/69 |
| 4,095,695 | 6/1978 | Steidinger | 206/610 |
| 4,157,759 | 6/1979 | Dicker | 206/610 |

*Primary Examiner*—William Price
*Assistant Examiner*—Bryon Gehman
*Attorney, Agent, or Firm*—Allegretti, Newitt, Witcoff & McAndrews, Ltd.

[57] ABSTRACT

A continuous business form assembly of a plurality of webs is disclosed. Two webs form a series of envelopes. Other webs form envelope inserts substantially free and loose in the envelopes. The inserts are joined to the assembly through only abbreviated tear tabs which are behind envelope tear strips and joined to insert web attachment strips formed into the envelopes.

4 Claims, 3 Drawing Figures

TOP OPEN RETURN ENVELOPE MAILER WITH TEAR TAB PERFORATIONS

This is a continuation of copending application Ser. No. 670,389, filed on Nov. 13, 1984, now abandoned.

BACKGROUND OF THE INVENTION

This invention relates to continuous business form assemblies, and more particularly, to such assemblies forming envelopes with removable insert sheets.

Substantial demand has existed in the past for continuous business form assemblies which provide envelopes with removable insert sheets. This demand has been primarily directed to a form construction which provides top opening envelopes or mailers with inserts which are as near conventional, personal envelopes as economically possible. A notable attempt to satisfy this demand has been the mailer of U.S. Pat. No. 4,157,759.

SUMMARY OF THE INVENTION

An object of the inventor in making this invention was to meet the demand described above.

Another object was to provide a continuous business form assembly which formed envelopes with inserts, such that the inserts were held in a secure, non-shifting manner while the assembly was being processed and such that the inserts were freed from the assembly upon opening of the envelopes. In the past, one or the other feature has not been present in a single assembly.

Without further elaboration, the invention is a continuous business assembly of a plurality of superimposed, continuous webs which define a series of form sets made of form sheets. Two of the form sheets are joined to form envelopes with pockets, tear strips, and tear strip lines between the pockets and tear strips. A third form sheet lies between the foregoing two form sheets as an insert in the pocket. The insert has a periphery consisting of a tear strip line edge and other edges. The insert is free and loose in the pocket along a portion of tear strip line edge and along all other edges.

The insert is joined to the assembly only through tear tabs in the area of the tear strips, which are joined to marginal feed strips of the assembly for secure positioning during processing.

The invention is best understood and appreciated by a careful reading of the illustrative detailed description of the preferred embodiment, which follows.

BRIEF DESCRIPTION OF THE DRAWING

The accompanying drawing includes three figures or FIGS. as follows.

Figure 1:
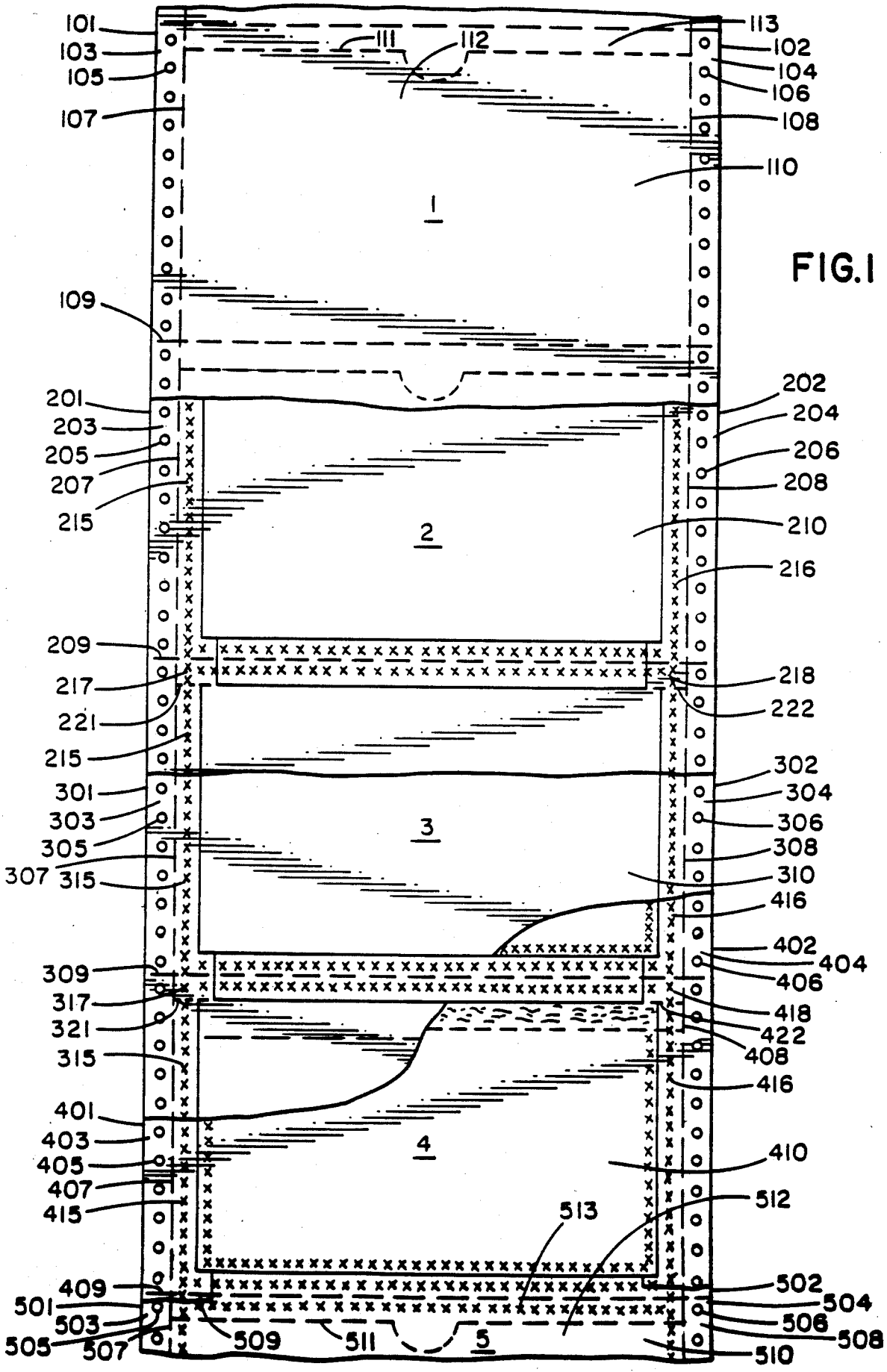
FIG. 1 is a plan view of the continuous business form assembly which is the preferred embodiment of the invention, progressively cut away sheet by sheet, from top to bottom, to reveal underlying detail.

The preferred embodiment of this invention is considered to be the best mode of carrying out the invention. The following description is of the preferred embodiment. This description is not intended to restrict the scope of patent protection, except to the extent expressly included in the claims or necessary for interpretation of the claims.

DETAILED DESCRIPTION OF THE PREFERRED EMBODIMENT

Referring to the accompanying drawing, the preferred embodiment of the invention is a continuous business form assembly 100. The assembly 100 consists of five continuous webs 1, 2, 3, 4, 5. The webs underlie each other in reverse number order.

All webs 1–5 are continuous in a longitudinal direction 6. All webs 1–5 have two longitudinally extending, opposed marginal edges. These edges are opposed to each other in a transverse direction perpendicular to the longitudinal direction 6. The first web marginal edges are 101, 102; the second web marginal edges are 201, 202; the third web marginal edges are 301, 302; the fourth web marginal edges are 401, 402; and the fifth web marginal edges are 501, 502. The edges 101, 201, 301, 401 and 501 directly underlie each other in reverse number order. The edges 102, 202, 302, 402 and 502 do the same. As a result, the webs 1–5 have a single, uniform transverse web width.

All the webs 1–5 further have longitudinally extending, opposed marginal feed strips with longitudinally extending series of spaced feed holes therein; and longitudinally extending marginal perforation lines adjacent the feed strips. The described elements of each web are as follows:

First Web

First web feed strips 103, 104
First web feed hole series 105, 106
First web marginal perforation lines 107, 108

Second Web

Second web feed strips 203, 204
Second web feed hole series 205, 206
Second web marginal perforation lines 207, 208

Third Web

Third web feed strips 303, 304
Third web feed hole series 305, 306
Third web marginal perforation lines 307, 308

Fourth Web

Fourth web feed strips 403, 404
Fourth web feed hole series 405, 406
Fourth web marginal perforation lines 407, 408

Fifth Web

Fifth web feed strips 503, 504
Fifth web feed hole series 505, 506
Fifth web marginal perforation lines 507, 508

The feed strips 103, 203, 303, 403, 503 directly underlie each other in reverse number order. The feed strips 104, 204, 304, 404, 504 do the same, as do the feed hole series 105, 205, 305, 405, 505; the feed hole series 106, 206, 306, 406, 506; the marginal perforation lines 107, 207, 307, 407, 507; and the marginal perforation lines 108, 208, 308, 408, 508.

All the webs 1–5 still further have a longitudinally spaced series of transversely extending transverse perforation lines. These lines extend from within one feed strip to within the other feed strip across each web; and adjacent lines in each web define form sheets of form sets in the webs. These lines and sheets are as follows:

First Web

First web transverse perforation line 109
First web form sheet 110

Second Web

Second web transverse perforation line 209
Second web form sheet 210

Third Web

Third web transverse perforation line 309
Third web form sheet 310

Fourth Web

Fourth web transverse perforation line 409
Fourth web form sheet 410

Fifth Web

Fifth web transverse perforation line 509
Fifth web form sheet 510

Figure 2:
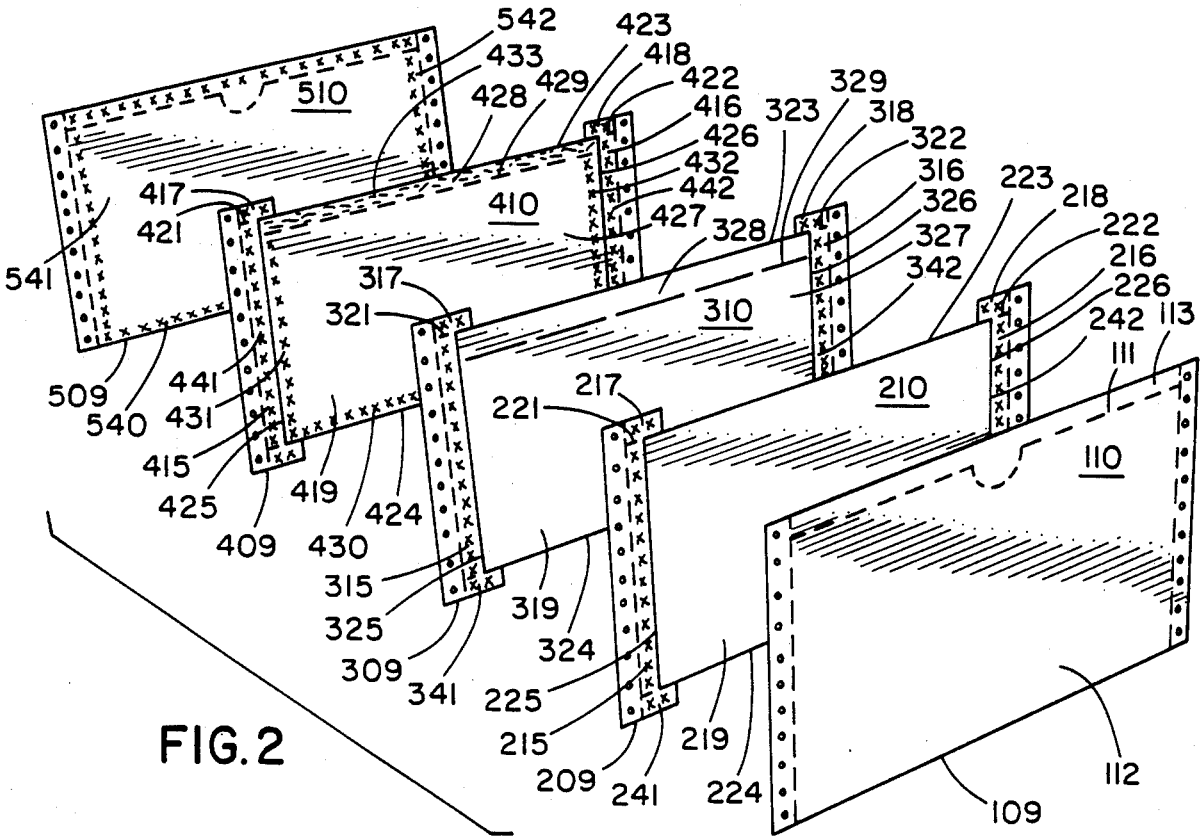
FIG. 2 is a perspective view of a single form set of the preferred continuous business form assembly, with the sheets of the set separated from each other.
Figure 3:
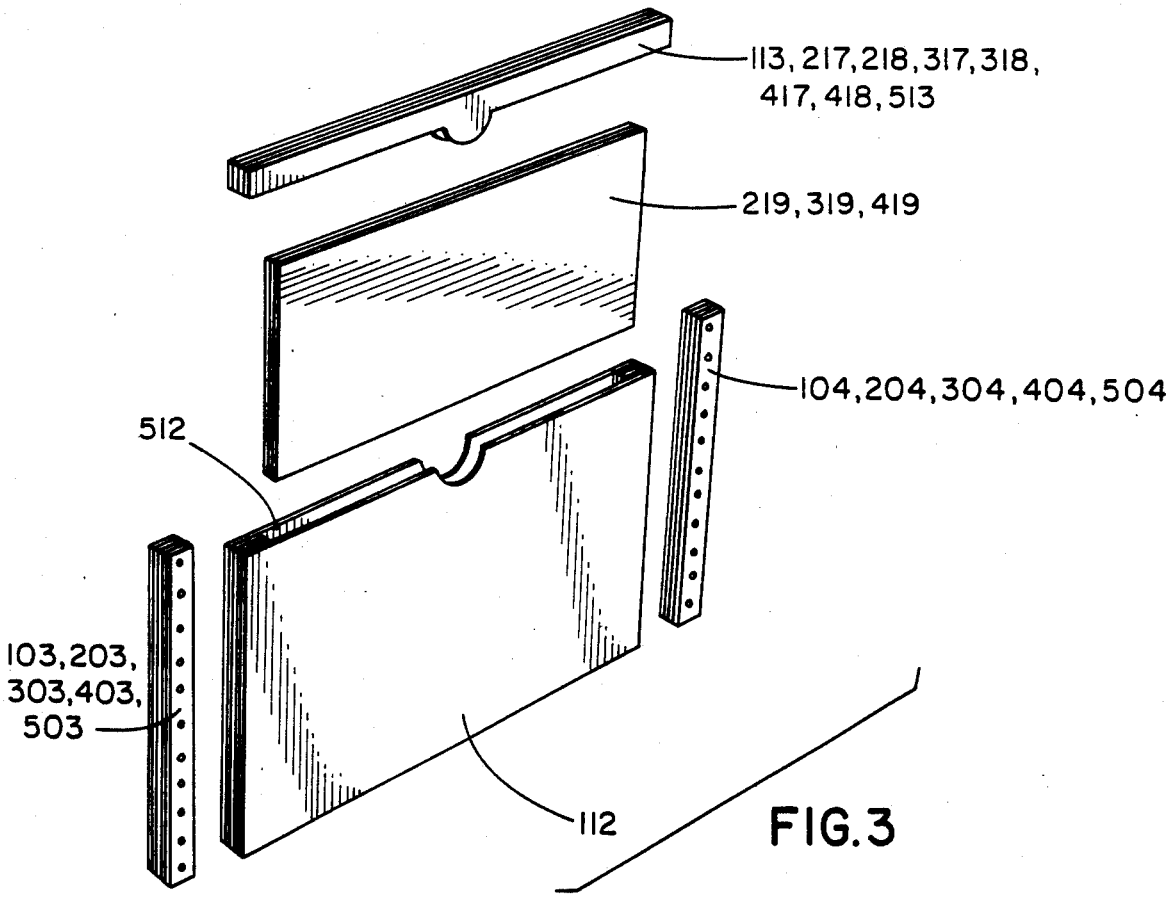
FIG. 3 is a perspective view of a single form set of the preferred continuous business form assembly, with portions of the set separated from each other as they are separated during use of the form set.

The lines 109, 209, 309, 409, 509 directly underlie each other in reverse number order, as do the form sheets 110, 210, 310, 410, 510. Each group of a single one each of the form sheets 110, 210, 310, 410, 510 constitutes a form set. One such form set is shown in FIGS. 2 and 3.

To this point, the structures of webs 1–5 have been identical. The structures now diverge. Webs 1 and 5 remain identical, as do webs 2–4. Webs 1 and 5 differ however, at this point, from webs 2–4.

Webs 1 and 5 each include a longitudinally extending series of transversely extending tear strip perforation lines; a series of envelope panels; and a series of tear strips. These lines, panels and strips are as follows:

First Web

First web tear strip perforation lines 111
First web envelope panels 112
First web tear strips 113

Fifth Web

Fifth web tear strip perforation lines 511
Fifth web envelope panels 512
Fifth web tear strips 513

The tear strips 113, 513 are located between the tear strip perforation lines 11, 511 and the adjacent lines 109, 509. The envelope panels 112, 512 are located between the lines 111, 511 and the lines 109, 509 downwardly remote therefrom.

The tear strip perforation lines 111, 511 are adjacent and downward as in FIG. 1, or rearward, by definition, of the transverse perforation lines 109, 209, 309, 409, 509. The lines 111, 511 extend from within the marginal feed strips across their webs 1, 5.

This structure completes webs 1 and 5.

Turning to FIG. 2 for convenience, webs 2–4 all include pairs of longitudinally extending, transversely opposed attachment strips, pairs of transversely opposed tear strips, centrally located insert sheets and pairs of transversely opposed, abbreviated tear tab perforation lines or line segments. These elements are as follows:

Second Web

Second web attachment strips 215, 216
Second web tear tabs 217, 218
Second web insert sheet 219
Second web tear tab perforation line segments 221, 222

Third Web

Third web attachment strips 315, 316
Third web tear tabs 317, 318
Third web insert sheet 319
Third web tear tab perforation line segments 321, 322

Fourth Web

Fourth web attachment strips 415, 416
Fourth web tear tabs 417, 418
Fourth web insert sheet 419
Fourth web tear tab perforation line segments 421, 422

Describing web 2 as an example of webs 2–4, the second web attachment strips 215, 216 are respectively transversely directly adjacent the second web marginal perforation lines 207, 208. Each attachment strip 215, 216 extends longitudinally forwardly from a second web transverse perforation line 209 across a form set to a tear tab perforation line 221 or 222 of that form set. The second web tear tab perforation line segments 221, 222 directly underlie the first web tear strip perforation line 111. The second web tear tabs 217, 218 underlie the first web tear strip 113.

The foregoing paragraph of description applies to webs 3 and 4 as well as web 2, except that elements 215, 315, 415 directly underlie each other in reverse number order, as do elements 216, 316, 416; 217, 317, 417; 218, 318, 418; 219, 319, 419; 221 321, 421; and 222, 322, 422.

Again as an example of webs 2–4, the insert sheet 219 of web 2 underlies the first web envelope panel 112. The insert sheet 219 is transversely adjacent and between the second web attachment strips 215, 216. The insert sheet 219 has a transversely extending forward edge 223 between the tear tabs 217, 218 that is free, i.e., not directly attached to any structure. The edge 223 directly underlies the first web tear strip perforation line 111. The insert sheet 219 also has a free, transversely extending rearward edge 224 and two free longitudinally extending side edges 225, 226. The rearward edge 224 is offset from the transverse perforation lines 109, 209, etc. The offset allows for direct attachment of the fifth web to the first web adjacent the lines 109, 209, etc. to the rearward of each form set, with freedom of the insert sheet 219 from the attachment.

The free side edges 225, 226 separate the insert sheet 219 from being directly joined to the attachment strips 215, 216. The edges 225, 226 extend from the rearward edge 224 to the tear tab perforation lines 221, 222. The second web insert sheets 219 are joined directly only to the tear tabs 217, 218, across the tear tab perforation line segments 221, 222.

The foregoing again applies to the webs 3 and 4 as to elements 323–326, 423–426 except for underlayment of elements in reverse number order as above.

Webs 3 and 4 now differ from web 2. Webs 3 and 4 each include in each insert sheet 319, 419 an auxiliary envelope panel 327, 427; an auxiliary tear strip 328, a glue strip 428; and an auxiliary tear strip perforation line 329, and a fold perforation 429; all respectively. The tear strip 328 and glue strip 428 and perforation lines 329, 429 extend transversely from side edge 325, 425 to side edge 326, 426, respectively. The tear strip 328 and glue strip 428 lie longitudinally adjacent the forward edges 323, 423, respectively and the lines 329, 429 lie adjacent the strips 328, 428, respectively. The lines 329, 429 underlie each other in reverse number order, as do the strips 328, 428 and the panels 327, 427.

The envelope panels 327, 427 of each form set of the third and fourth webs 3, 4 are joined along the side and rearward edges 324–326 and 424–426 to form an auxiliary envelope pocket. Lines of adhesive 430, 431, 432 accomplish the joining. A line of wettable adhesive 433 along the glue strip 428 provides for sealing, when desired, by folding down strip 428 and sealing to the face of insert 319 and thereby forming the envelope pocket.

The form sheets of the first and fifth webs 1, 5 and the attachment strips of the second through fourth webs 2–4 are also jonied to form a primary envelope. The first and fifth webs 1, 5 are joined directly together along the rearward lines 109, 509 of the envelope panels 112, 512 by a series of longitudinally spaced, transversely extending lines of adhesive 540. The second web attachment strips 215, 216 are joined to the first web form sheets by continuous, longitudinally extending lines of adhesive 241, 242. The remaining attachment strips 315, 316, 415, 416 are joined to the second web attachment strip and to each other in reverse number order by adhesive lines 341, 342, 441, 442. The fifth web 5 is then joined to the fourth web attachment strips 415, 416 by similar adhesive lines 541, 542.

As now described, the webs 1–5 form a series of form sets which each include a primary envelope containing a temporarily fixed and removable auxiliary envelope and an accompanying insert sheet 219. The primary envelope is usable as an outgoing envelope in the mailing of bills or the like. The insert sheet may be a statement, and the auxiliary envelope a return envelope. Carbon and similar material may be used in patches as desired on the form sheets of the form sets, and the forms may be computer printed, with the form sheets maintained in registry with each other by the feed strips. Upon completion to the point of individual use, the form sets may then be separated from each and their feed strips by perforation along the lines 109, 209, etc.

A form set recipient may then receive one form set, and open it along the tear strip perforation lines 111, 511. Tearing along these lines causes tearing along the tear tab perforation line segments 221, 222, etc. which releases the insert sheets 219, etc., as in FIG. 3.

The preferred embodiment of the invention is now described. This preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

What I claim is:

1. A continuous business form assembly comprising a plurality of superimposed webs each being continuous in a longitudinal direction, having longitudinally extending marginal edges which are opposed to each other in a transverse direction perpendicular to the longitudinal direction, the webs being superimposed on each other, having a longitudinally spaced series of transversely extending transverse perforation lines, and defining a longitudinally extending series of form sets between the perforation lines, and the webs including a plurality of form sheets in each set including a first form sheet, a second form sheet, and last form sheet;

the first and last form sheets being joined to form an envelope with a pocket, a top, transverse tear strip, and a top, transverse tear strip line between the pocket and the top, transverse tear strip, the second of the form sheets being between the first and last form sheets, defining an insert in the pocket and having a periphery consisting of a top, transverse tear strip line edge and other edges, the web which includes the insert additionally having two tear tabs and two tear tab perforation lines disposed between the two tear tabs and the insert, the top, transverse tear strip line edge being defined by the two tear tab perforation lines and a central portion, the central portion being positioned between the two tear tab perforation lines, the insert being free and loose in the pocket from the first and last form sheets and all the webs along the central portion of the top, transverse tear strip line edge and along the other edges and being attached to and made a part of the second form sheet only along the two tear tab perforation lines, the two tear tab perforation lines underlying the top, transverse tear strip line.

2. A continuous business form assembly as in claim 1 in which the second form sheet defining the insert includes longitudinally extending continuous strips, the two tear tabs being joined to the continuous strips.

3. A continuous business form assembly as in claim 2 in which the continuous strips of the second form sheet defining the insert are joined to the first and last form sheets which form the envelope.

4. A continuous business form assembly as in claim 3 in which the continuous strips are a part of the envelope.

* * * * *